US008942616B2

(12) United States Patent
Sunahara

(10) Patent No.: US 8,942,616 B2
(45) Date of Patent: Jan. 27, 2015

(54) CLEANING MEMBER, CLEANING DEVICE AND PROCESS CARTRIDGE

(75) Inventor: Satoshi Sunahara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 54 days.

(21) Appl. No.: 13/611,585

(22) Filed: Sep. 12, 2012

(65) Prior Publication Data

US 2013/0071164 A1 Mar. 21, 2013

(30) Foreign Application Priority Data

Sep. 15, 2011 (JP) ..... 2011-201836

(51) Int. Cl.

| | |
|---|---|
| ***G03G 21/10*** | (2006.01) |
| ***G03G 21/18*** | (2006.01) |
| ***B08B 1/00*** | (2006.01) |
| ***G03G 21/00*** | (2006.01) |

(52) U.S. Cl.

CPC ..... *B08B 1/005* (2013.01); *G03G 21/0029* (2013.01)

USPC ..... 399/350; 15/256.52; 399/111; 399/351

(58) Field of Classification Search

CPC ..... G03G 21/0029; G03G 21/0011; G03G 21/18; G03G 15/161; G03G 2215/1647; G03G 2221/0026; G03G 2221/0089; A47L 17/06

USPC ..... 399/351, 350, 111, 123, 101; 15/1.51, 15/236.01, 256.5, 256.51, 256.52

See application file for complete search history.

(56) References Cited

U.S. PATENT DOCUMENTS

| | | | | |
|---|---|---|---|---|
| 4,334,766 | A * | 6/1982 | Sugiyama et al. | 399/351 |
| 5,517,294 | A * | 5/1996 | Ogiri et al. | 399/351 |
| 7,158,749 | B2 * | 1/2007 | Ueno et al. | 399/351 |
| 2010/0067945 | A1 * | 3/2010 | Hozumi et al. | 399/111 |
| 2011/0052288 | A1 * | 3/2011 | Koido | 399/351 |

FOREIGN PATENT DOCUMENTS

| | | | |
|---|---|---|---|
| JP | 1-235987 | A | 9/1989 |
| JP | 4-172486 | A | 6/1992 |
| JP | 6-186890 | A | 7/1994 |
| JP | 2006-259394 | A | 9/2006 |

* cited by examiner

*Primary Examiner* — Sophia S Chen

(74) *Attorney, Agent, or Firm* — Fitzpatrick, Cella, Harper & Scinto

(57) ABSTRACT

A cleaning member for removing a developer from a surface of a member to be cleaned is provided. The cleaning member includes a blade portion contactable to the member to be cleaned and a flexible supporting member for supporting the blade portion. The supporting member includes a blade supporting portion for supporting the blade portion, a portion to be fixed to a fixing portion, and a bent portion provided at a longitudinal end portion of the blade supporting portion.

30 Claims, 10 Drawing Sheets

CLEANING MEMBER, CLEANING DEVICE AND PROCESS CARTRIDGE

FIELD OF THE INVENTION AND RELATED ART

The present invention relates to a cleaning member, a cleaning device and a process cartridge which are used in a printer, a copying machine or the like of an electrophotographic type.

In an image forming apparatus of the electrophotographic type such as a laser beam printer, the copying machine or the like, first, an electrostatic latent image is formed by irradiating a uniformly charged electrophotographic photosensitive member with light (laser light or the like) corresponding to image information. Thereafter, the electrostatic latent image is visualized (developed) as a developer image (toner image) by supplying a developer (toner) thereto by a developing means, and the developer image is transferred from the photosensitive member onto a recording material such as paper. Thus, an image is formed on the recording material and then is outputted.

With respect to the developer remaining on the photosensitive member without being transferred, a constitution in which the developer is removed by a cleaning device provided in contact with the photosensitive member has been widely used. As a constitution of the cleaning device, a rubber blade structure in which a metal plate which is a rigid member is used as a supporting member and an urethane rubber portion provided at an end portion of the supporting member is contacted to the photosensitive member is generally well known.

In this constitution, such a problem that a longitudinal contact state is changed due to a manner of mounting the rubber blade to a container and the rubber blade structure itself has been known. In order to solve the problem, a constitution in which a penetration depth of a metal plate into a rubber portion is changed with respect to a longitudinal direction (Japanese Laid-Open Patent Application (JP-A) Hei 01-235987 and JP-A Hei 06-186890) and a constitution in which a free length of the rubber portion is changed (JP-A 2006-259394) have been proposed.

On the other hand, a constitution in which a plate-like spring member is used as the supporting member and the rubber portion such as urethane rubber portion is provided at an end portion of the plate-like spring member and is contacted to the photosensitive member has also been proposed (JP-A Hei 04-172486). In such a constitution, not only the rubber portion is deformed but also the plate-like spring member is deformed.

In the cleaning member including the plate-like spring member and the rubber portion which is provided at the end portion contacting the photosensitive member and which is supported by the plate-like spring member, the plate-like spring member itself has elasticity and therefore rigidity of the supporting member is inferior to a supporting member constituted by the metal plate. Further, the longitudinal end of the plate-like spring member is the free end and therefore is liable to be deformed compared with a longitudinal central portion. For that reason, in the case where the cleaning member is contacted to the photosensitive drum (photosensitive member), a contact state of the cleaning member to the drum is liable to change with respect to the longitudinal direction, so that there is a possibility that a cleaning property becomes non-uniform with respect to the longitudinal direction.

SUMMARY OF THE INVENTION

A principal object of the present invention is to maintain a stable cleaning property by suppressing non-uniformity of contact pressure applied to a member to be cleaned with respect to a longitudinal direction in a cleaning member including a flexible supporting member.

According to an aspect of the present invention, there is provided a cleaning member for removing a developer from a surface of a member to be cleaned, the cleaning member comprising: a blade portion contactable to the member to be cleaned; and a flexible supporting member for supporting the blade portion, the supporting member comprising a blade supporting portion supporting the blade portion, a portion to be fixed for being fixed to a fixing portion, and a bent portion provided at a longitudinal end portion of the blade supporting portion.

According to another aspect of the present invention, there is provided a cleaning device including the cleaning member.

According to a further aspect of the present invention, there is provided a process cartridge including the cleaning member.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Parts (a), (b) and (c) of FIG. 1 are illustrations showing a structure of a cleaning member in Embodiment 1.

Figure 3:
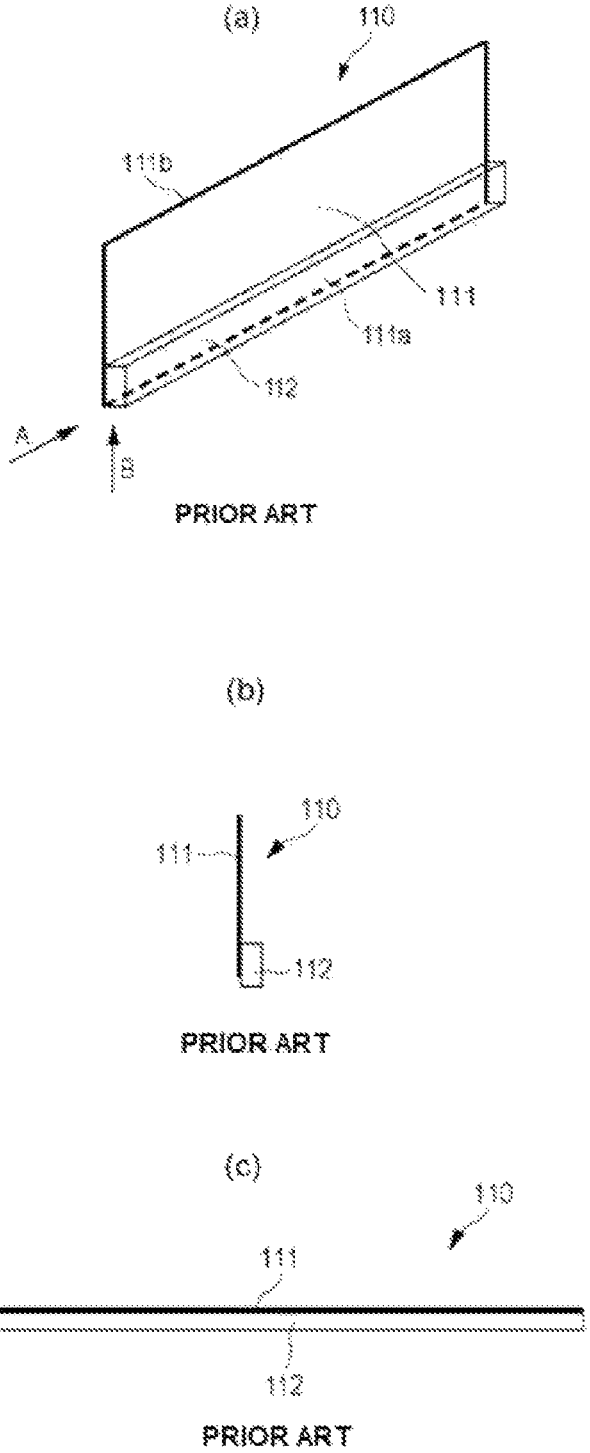

Parts (a), (b) and (c) of FIG. 3 are illustrations showing a structure of a cleaning member in Comparative Embodiment in which there is no bent portion at longitudinal end portions.

Figure 4:
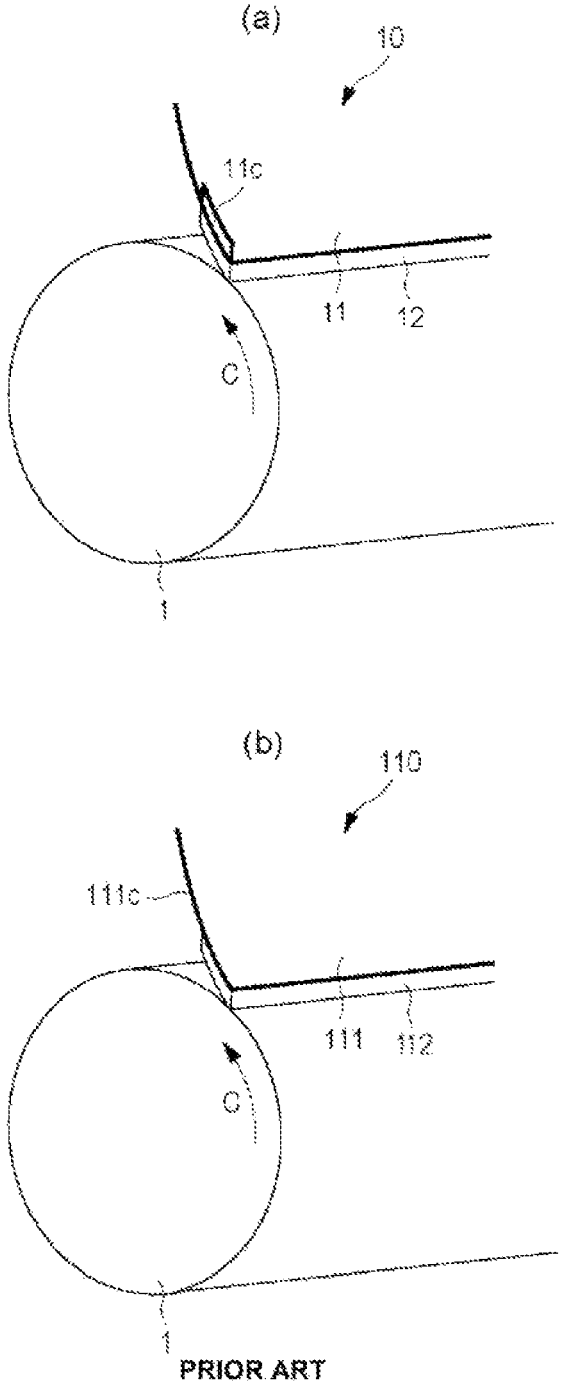

Parts (a) and (b) of FIG. 4 are illustrations showing states of deformation of the cleaning members, in Embodiment 1 and Comparative Embodiment, respectively, at a longitudinal end portion when a photosensitive drum contacts the cleaning member.

Figure 5:
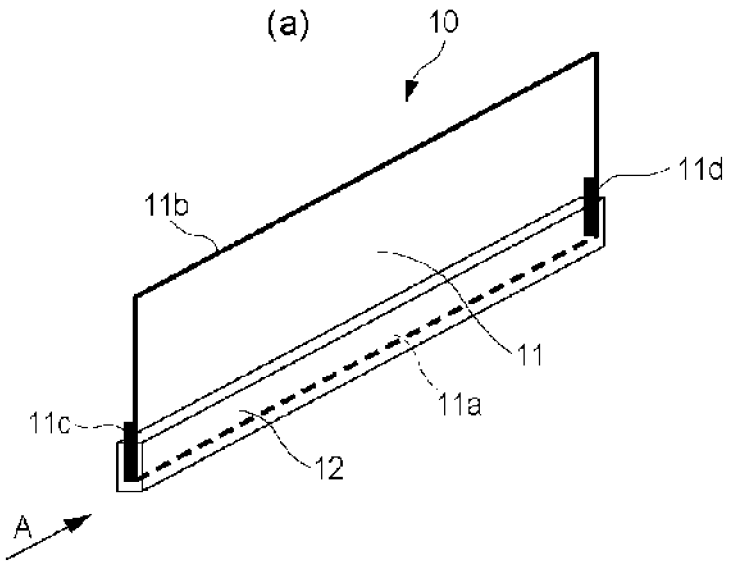
Figure 5:
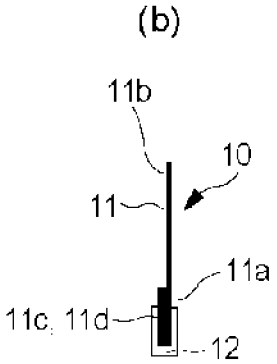

Parts (a) and (b) of FIG. 5 are illustrations showing a cleaning member in which an end of a supporting member is covered with a blade portion in Embodiment 1.

Figure 6:
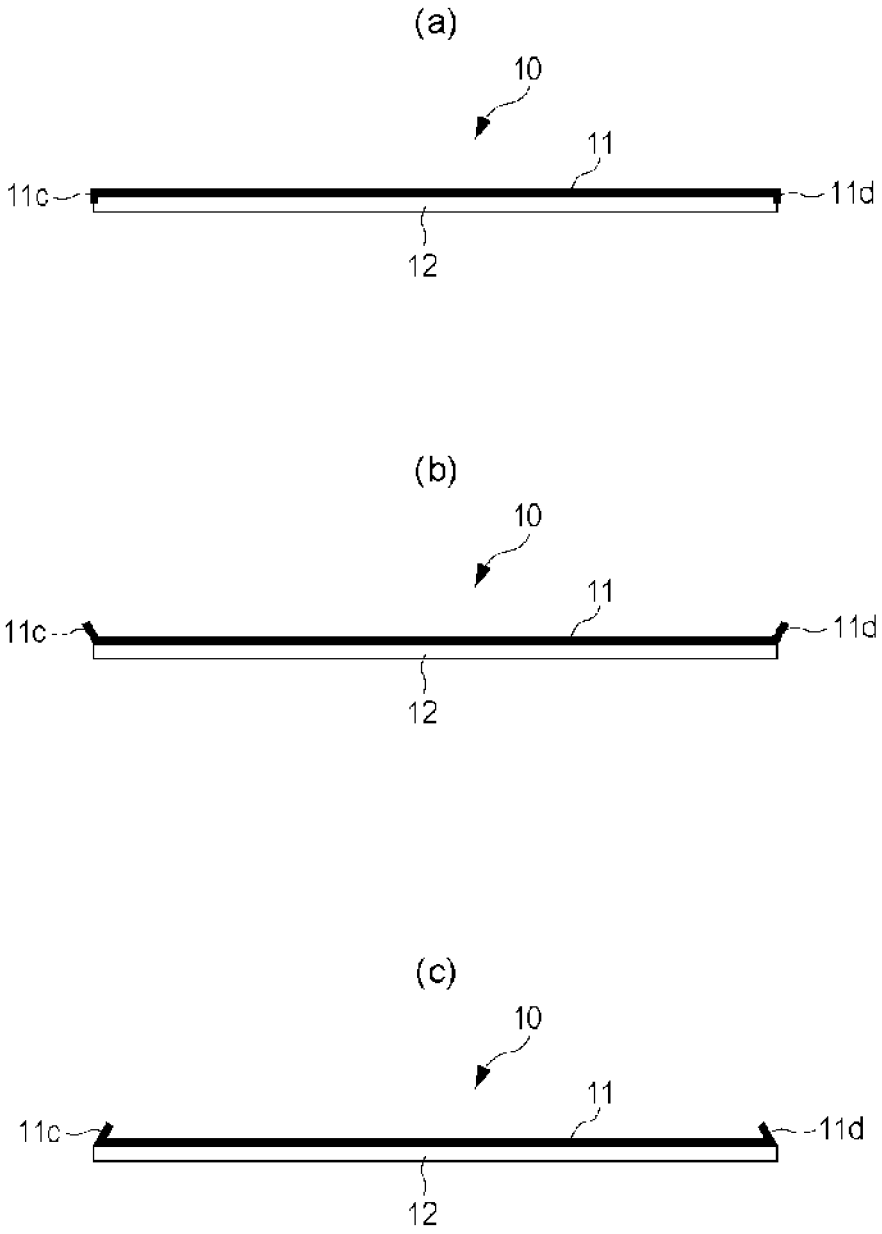

Parts (a), (b) and (c) of FIG. 6 are illustrations each showing a modified example of the bent portion in Embodiment 1.

Figure 7:
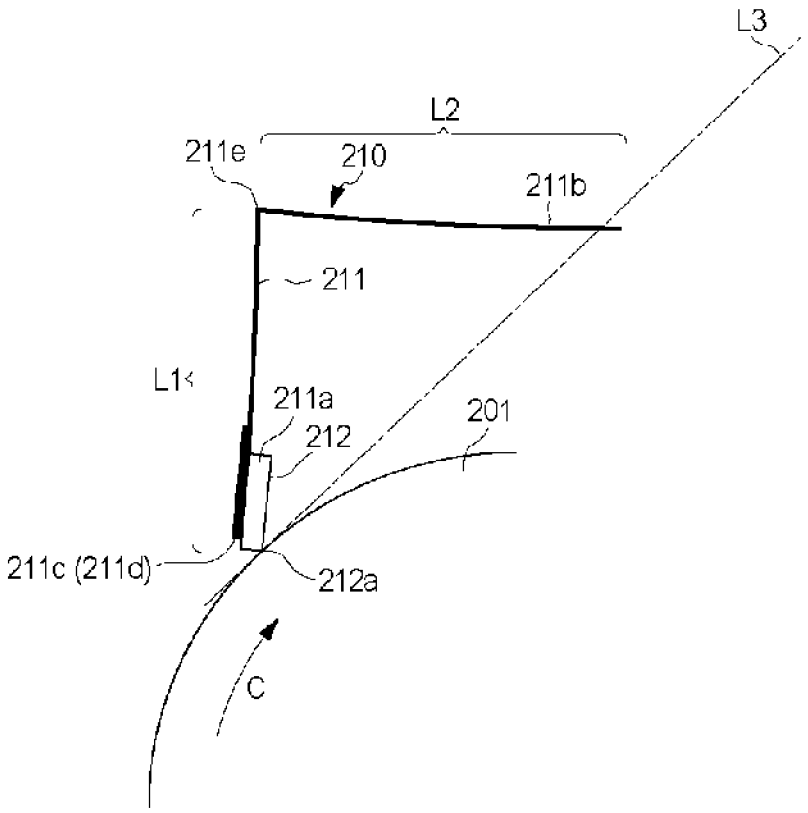

FIG. 7 is an illustration showing a structure of a cleaning member in Embodiment 2.

Figure 8:
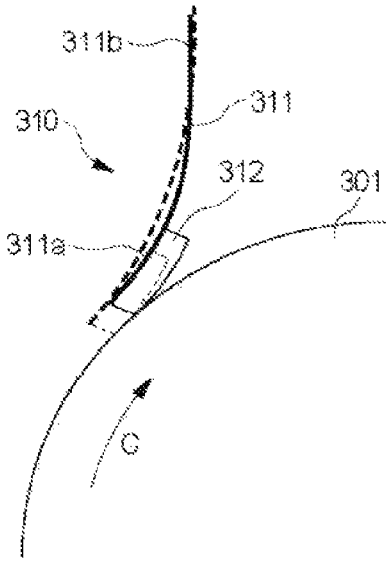
PRIOR ART Fig. 8

FIG. 8 is an illustration showing a state of deformation of the cleaning member in Comparative Embodiment when a friction coefficient of a photosensitive drum surface is increased.

Figure 9:
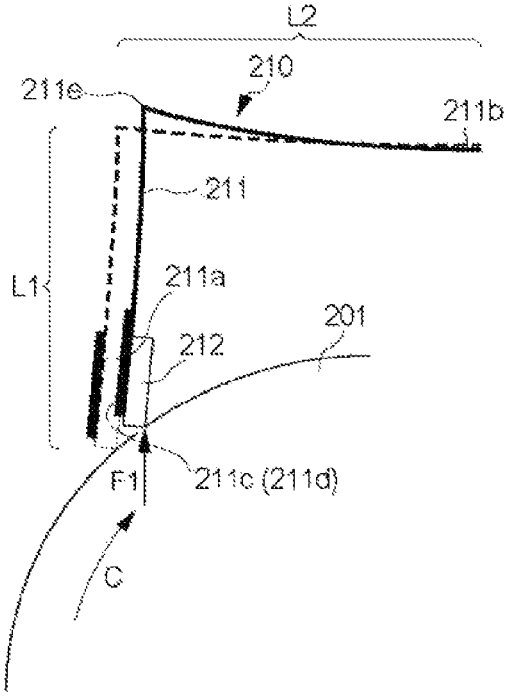

FIG. 9 is an illustration showing a state of deformation of the cleaning member in Embodiment 2 when a friction coefficient of a photosensitive drum surface is increased.

Figure 10:
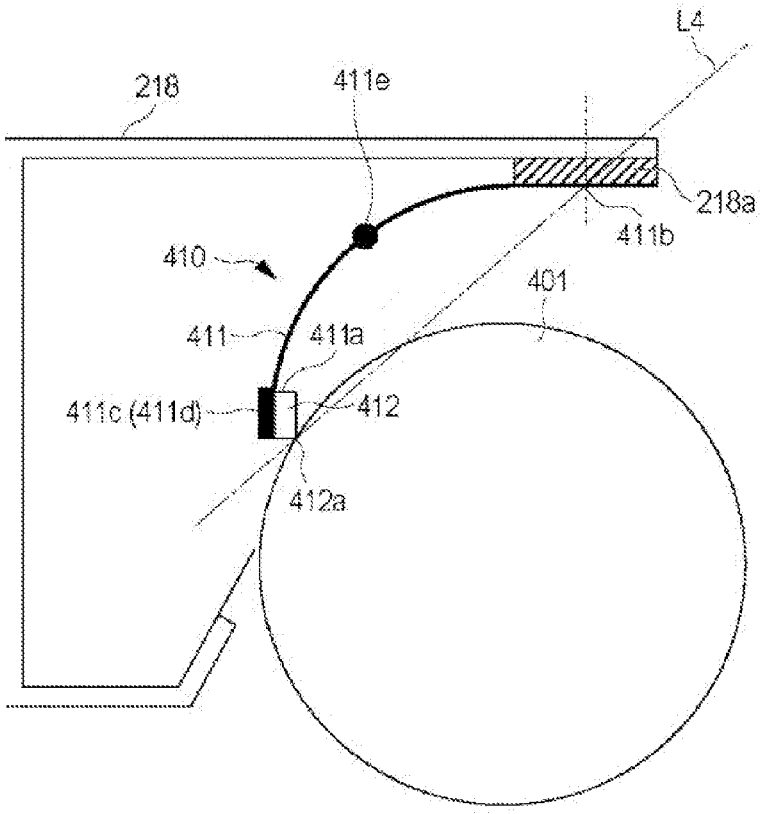

FIG. 10 is an illustration showing a structure of the cleaning member in Embodiment 2 in which the supporting member has a curved shape.

Figure 11:
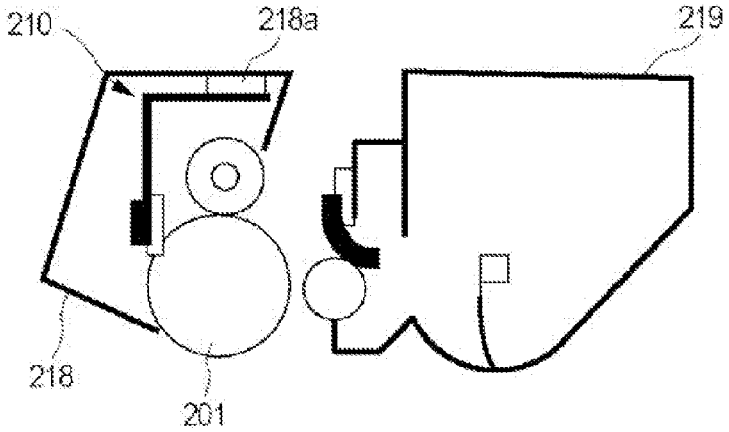

FIG. 11 is an illustration showing a process cartridge including the cleaning member in Embodiment 2.

Figure 12:
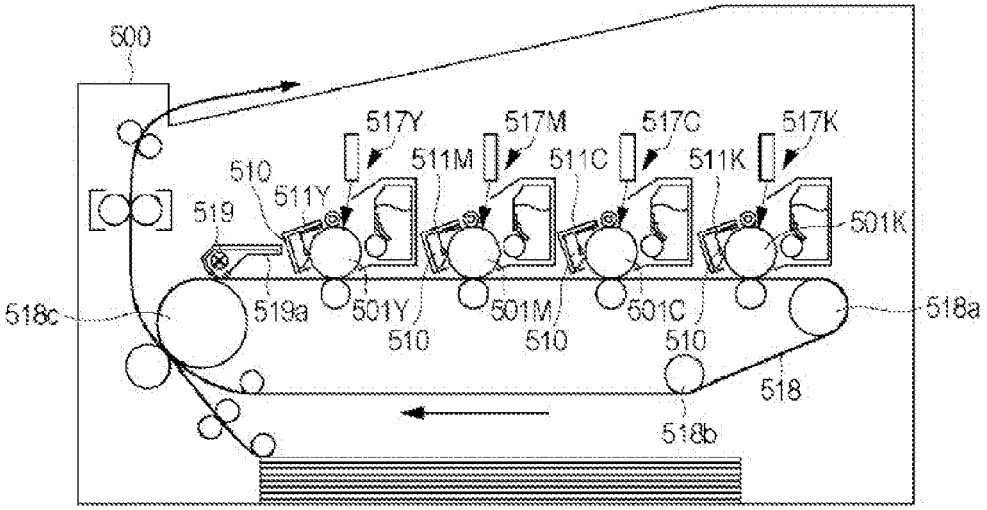

FIG. 12 is a schematic illustration of an image forming apparatus in Embodiment 3.

Figure 13:
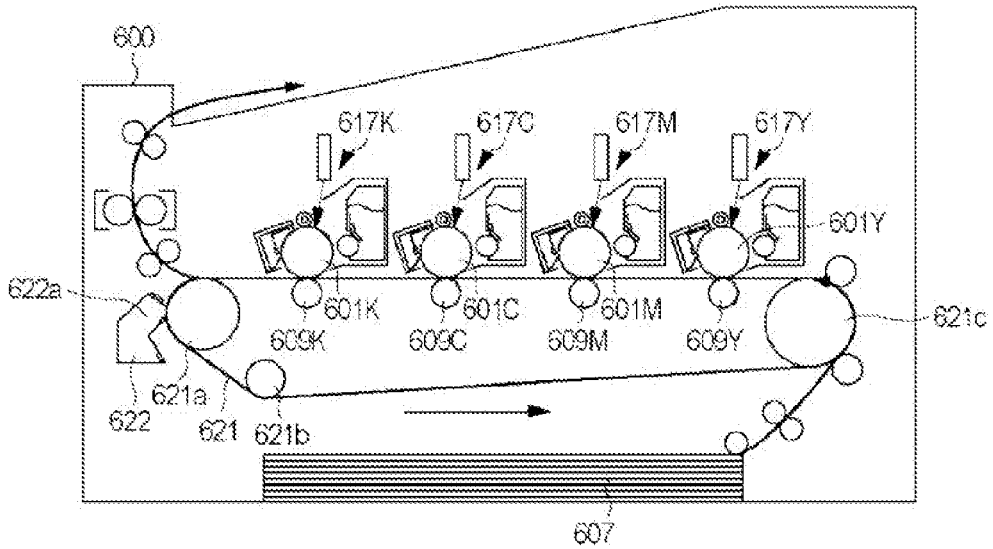

FIG. 13 is a schematic illustration of an image forming apparatus in Embodiment 4.

DESCRIPTION OF THE PREFERRED EMBODIMENTS (Embodiment 1)

Figure 2:
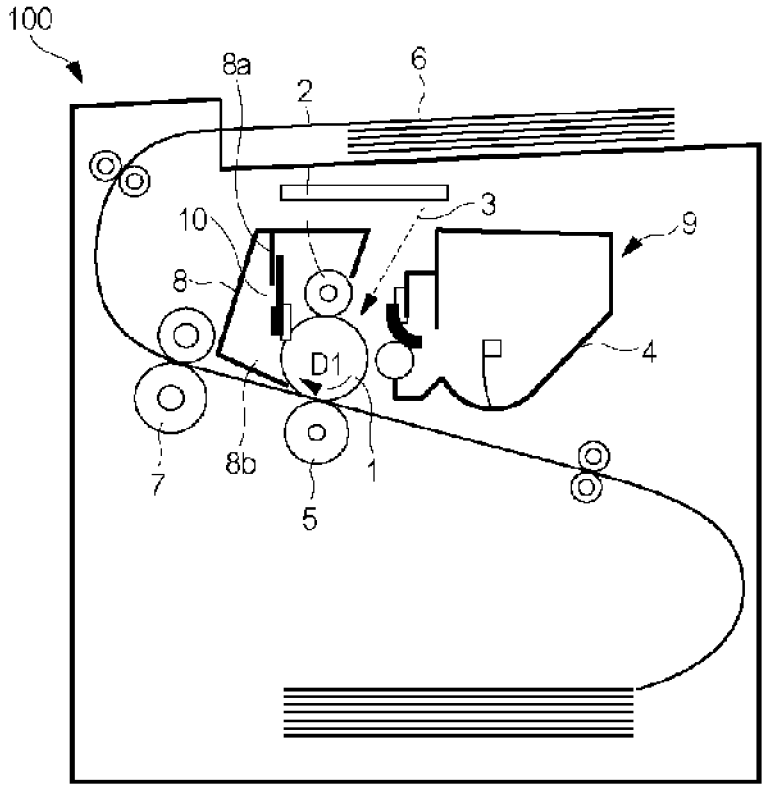
FIG. 2 is a schematic illustration of an image forming apparatus including the cleaning member in Embodiment 1.

FIG. 2 is a sectional view of an image forming apparatus 100 to which a process cartridge 9 including a cleaning member in this embodiment is detachably mountable. First, an operation of the image forming apparatus 100 will be briefly described. To a photosensitive drum 1 as an image bearing member (member to be cleaned), a charging roller 2 as a contact charging member is contacted and then a charging bias is applied. Then, after the surface of the photosensitive drum 1 is uniformly charged, an electrostatic latent image is formed on the photosensitive drum 1 by an exposure means 3 such as a laser. Thereafter, the electrostatic latent image is developed by a developing device 4 and a resultant toner image is transferred onto a toner image receiving material 6 by a transfer means 5 and then is fixed by a fixing means 7 to obtain an image on the toner image receiving material 6. On the other hand, a developer remaining on the photosensitive drum 1 without being transferred is removed by a cleaning member 10 contacted to the photosensitive drum 1 in a counter direction to a movement direction D1 of the photosensitive drum 1, thus being collected in a toner accommodating portion 8*b* formed by a cleaner container 8 as a frame.

Figure 1:
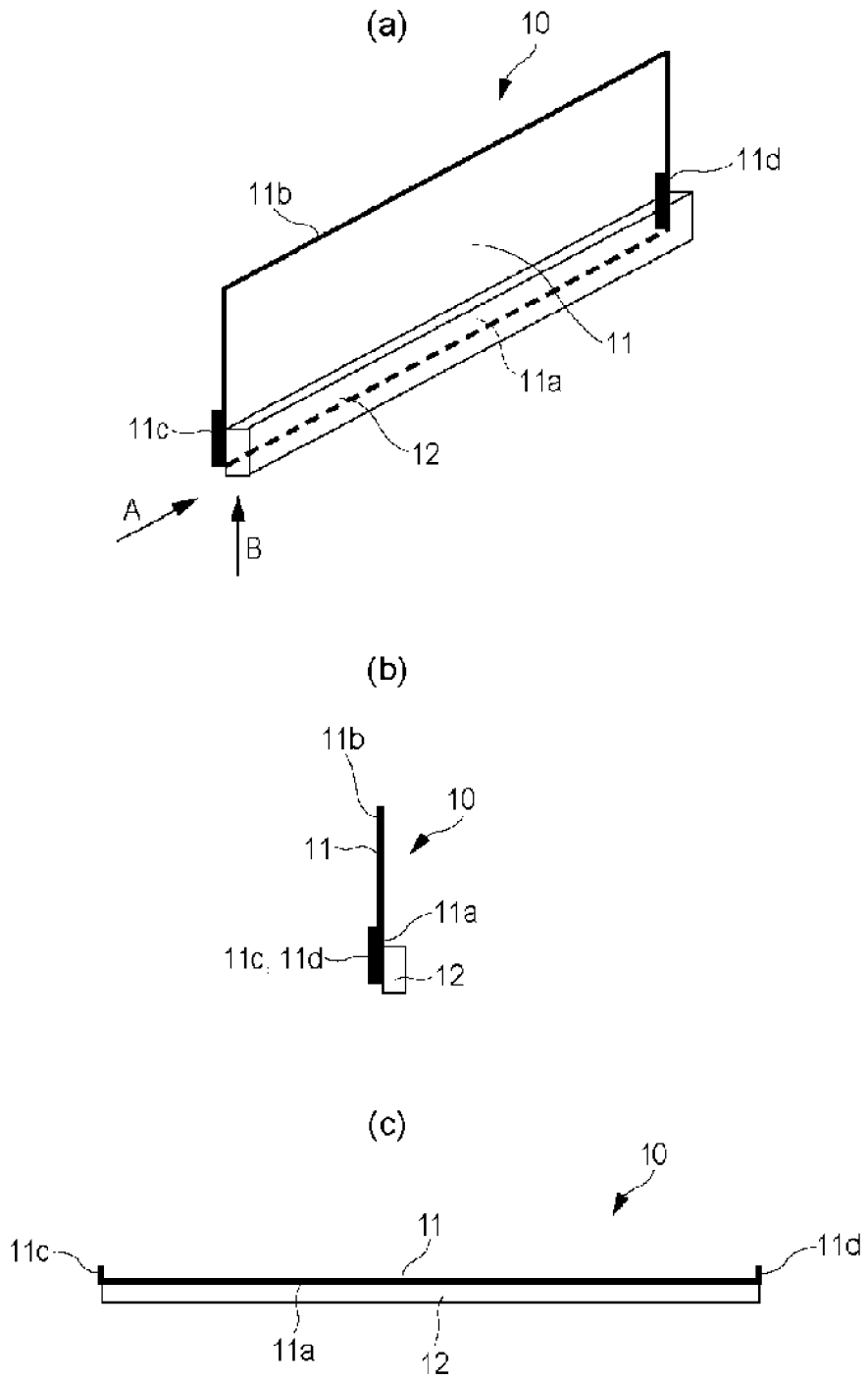

The cleaning member 10 in this embodiment is shown in (a) to (c) of FIG. 1. Part (a) of FIG. 1 is a perspective view showing a structure of the cleaning member 10 in this embodiment. Part (b) of FIG. 1 is a sectional view of the cleaning member 10 as seen from a longitudinal end portion direction (side) indicated by an arrow A in (a) of FIG. 1, and (c) of FIG. 1 is a sectional view of the cleaning member 10 as seen from a blade portion end direction (side) indicated by an arrow B in (a) of FIG. 1.

The cleaning member 10 in this embodiment is prepared by applying and fixing a blade portion 12, contactable to the photosensitive drum 1, to a blade supporting portion 11*a* of a flexible supporting member 11 of a thin metal plate spring. Further, a portion to be fixed 11*b* is fixed to a fixing portion 8*a* of the cleaner container 8 as the frame by an unshown screw, thermal caulking or the like. The cleaning member 10 has a spring property at not only the blade portion 12 but also the supporting member 11, so that deformation of the blade portion 12 is not readily caused while ensuring a contact pressure necessary for cleaning. In this embodiment, an urethane rubber material was used for the blade portion 12, and a phosphor bronze material was used for the supporting member 11.

Further, the blade supporting portion 11*a* of the supporting member 11 is provided with first bent portions 11*c* and 11*d* at its longitudinal end portions as shown in FIG. 1. A direction of the bent portions 11*c* and 11*d* was such that it is perpendicular to the longitudinal direction and each bent portion extends in a remote direction from the photosensitive drum 1. An effect of the bent portions 11*c* and 11*d* will be described by comparison with Comparative Embodiment in which a cleaning member has the substantially same constitution as that in this embodiment except that the longitudinal end bent portions are not provided.

A structure of cleaning member 110 in Comparative Embodiment is shown in (a) to (c) of FIG. 3. Similarly as in FIG. 1, (a) of FIG. 3 is a perspective view showing a structure of the cleaning member 110 in this embodiment. Part (b) of FIG. 3 is a sectional view of the cleaning member 110 as seen from a longitudinal end portion direction (side) indicated by an arrow A in (a) of FIG. 3, and (c) of FIG. 3 is a sectional view of the cleaning member 10 as seen from a blade portion end direction (side) indicated by an arrow B in (a) of FIG. 3.

The cleaning member 110 in Comparative Embodiment is prepared by applying and fixing a blade portion 112, contactable to the photosensitive drum, to a blade supporting portion 111*a* of a flexible supporting member 111 of a thin metal plate spring. Further, a portion to be fixed 111*b* is fixed to a fixing portion of the cleaner container as the frame.

In this embodiment and Comparative Embodiment, states in which the blade is urged and deformed when the cleaning member is contacted to the photosensitive drum are shown in (a) and (b) of FIG. 4, respectively, as a perspective view as seen from a back side of the blade portion.

Part (a) of FIG. 4 shows the contact state at the end portion in this embodiment by providing the bent portions 11*c* and 11*d*, even in the case where the supporting member 11 which is the thin metal plate is used, deformation of the supporting member 11 caused at longitudinal end portions by the contact with the photosensitive drum 1 can be suppressed. As a result, a degree of a lowering in contact pressure of the supporting member 11 to the photosensitive drum 1 at the longitudinal end portions becomes small, so that the contact pressure can be stabilized. That is, a stable cleaning property of the cleaning member 10 can be maintained.

On the other hand, (b) of FIG. 4 shows the contact state of the cleaning member 110 at the longitudinal end portion in Comparative Embodiment. The cleaning member 110 is not provided with the longitudinal end bent portions and therefore in the case where the thin metal plate is used as the supporting member 111, a free end 111*c* which is the longitudinal end portion is liable to be deformed more than the longitudinal central portion. Thus, there is a possibility that the contact state becomes unstable at the longitudinal end portions.

In this embodiment, in not only the constitution in which the blade portion 12 is applied to the blade supporting portion 11*a* of the supporting member 11 but also outset molding in which the neighborhood of the end which is the blade supporting portion 11*a* of the supporting member 11 is covered with the blade portion 12 as shown in FIG. 5, a similar effect can be achieved. Further, the materials for the blade portion 12 and the supporting member 11 are not limited to those described in this embodiment. That is, the material for the blade portion 12 is not limited to the urethane rubber material but may also be another material. Further, the supporting member 11 is not limited to the metal material but may also be a flexible resin material.

Modified examples of the bent portion in this embodiment will be described with reference to (a), (b) and (c) of FIG. 6 as seen from the arrow B direction in (a) of FIG. 1.

The case where the bent direction is opposite to that in FIG. 1, i.e., is an approach direction to the photosensitive drum 1 is shown in (a) of FIG. 6 but there is of no problem when the bent portions 11*c* and 11*d* are disposed so as not to contact the photosensitive drum 1, so that this case can also be carried out.

In this embodiment, an angle formed between the bent portion 11*c* (11*d*) and the blade supporting portion 11*a* of the supporting member 11 is a right angle, but as shown in (b) of FIG. 6, even in a constitution in which the angle is an obtuse angle, the effect can be achieved. Further, even in a constitution in which the angle is an acute angle as shown in (c) of FIG. 6, the end portion deformation as described with reference to (b) of FIG. 4 can be made less unlikely to occur. However, there is a high possibility that the rigidity of the blade supporting portion 11*a* at the longitudinal end portions is higher than that at the longitudinal central portion. Further, as also shown in FIG. 5, in the type in which the end of the blade supporting portion 11*a* is covered with the blade portion 12, the rigidity of the blade supporting portion 11*a* apparently becomes large at the longitudinal end portions and therefore, the angle between the bent portion and the blade supporting portion may desirably be a right angle (90 degrees) or more.

Further, in the cleaning member 10 as in this embodiment, when the bent portion is provided over the entire region with respect to a widthwise direction perpendicular to the longitudinal direction, there is a possibility that a spring property (flexibility) of the supporting member 11 is impaired and thus the supporting member 11 is not readily deformed. For that reason, the bent portions 11*c* and 11*d* may desirably be provided in a part of the entire widthwise region of the supporting member 11, i.e., provided at least at longitudinal end portions of the blade supporting portion 11*a*. This is because by providing the bent portions 11*c* and 11*d* at the longitudinal end portions of the blade supporting portion 11*a* for supporting the blade portion 12, the contact pressure of the blade portion 12 to the photosensitive drum 1 is stabilized.

(Embodiment 2)

In this embodiment, a cleaning member 210 having a second bent portion provided to a supporting member with respect to the widthwise direction of the supporting member will be described.

FIG. 11 is a sectional view of a process cartridge 219 including the cleaning member 210 in this embodiment. FIG. 7 is an illustration showing a detailed structure of the cleaning member 210. A constitution in which a blade portion 212 is mounted to a blade supporting portion 211*a* of a supporting member 211 formed with the thin metal plate is the same as that in Embodiment 1. Further, a constitution in which a portion to be fixed 211*b* of the supporting member 211 is fixed to a fixing portion 218*a* of a cleaner container 218 as the frame by the unshown screw, thermal caulking or the like is also the same as that in Embodiment 1. In addition, at longitudinal end portions of the blade supporting portion 211*a* of the supporting member 211, similarly as in Embodiment 1, first bent portions 211*c* and 211*d* are formed. However, the supporting member 211 in this embodiment includes a bent portion 211*e*, as the second bent portion, between the blade supporting portion 211*a* and the portion to be fixed 211*b* with respect to the widthwise direction perpendicular to the longitudinal direction of the blade portion 212. The bent portion 211*e* is provided in a side remote from a surface of a photosensitive drum 201 toward an outside with respect to a line segment L3 connecting the portion to be fixed 211*b* and a contact portion 212*a* where the blade portion 212 is contacted to the photosensitive drum 201 as a member to be cleaned.

In the following description, a portion ranging from the bent portion 211*e* to the end of the blade supporting portion 211*a* is referred to as L1 portion (one end portion), and a portion ranging from the end of the portion to be fixed 211*b* to the bent portion 211*e* is referred to as L2 portion (another end portion).

FIG. 8 shows, as Comparative Embodiment, a cleaning member 310 including a supporting member 311 which is not provided with the second bent portion between a blade supporting portion 311*a* and a portion to be fixed 311*b*. With respect to the cleaning member 310, a state in which the supporting member 311 is deformed when a friction coefficient between a photosensitive drum 301 and a blade portion 312 provided on the blade supporting portion 311*a* is increased is indicated by a solid line in FIG. 8. Further, a broken line in FIG. 8 represents a state of the supporting member 311 when the friction coefficient between the photosensitive drum 301 and the blade portion 312 is low. When the friction coefficient is increased, in a downstream direction of a rotational direction C of the photosensitive drum 301, the supporting member 311 is deformed and further pressed against the photosensitive drum 301 and therefore the contact pressure tends to increase.

On the other hand, as shown in FIG. 7, in the constitution in which the supporting member 211 is provided with the bent portion 211*e*, even when the process cartridge between the surfaces of the photosensitive drum 201 and the blade portion 212 is increased, the blade portion 212 is readily flexed.

FIG. 9 shows a state of deformation of the supporting member 211 when the friction coefficient between the photosensitive drum 201 and the blade portion 212 is increased. The supporting member 211 when the friction coefficient is low is indicated by a broken line in FIG. 9, and the supporting member when the friction coefficient is high is indicated by a solid line in FIG. 9. As indicated by the solid line in FIG. 9, even when the friction coefficient in increased and thus the L1 portion is further pressed against the photosensitive drum 201, the L2 portion is readily flexed. This is because the L2 portion is bent by the bent portion 211*e* in a direction crossing the L1 portion. That is, the L1 portion itself is not so deformed since an angle between itself and a direction of a force F1 applied from the photosensitive drum 201 onto the blade portion 212 is not so large. However, the L2 portion which receives the force from the L1 portion provides an angle, between itself and the L1 portion, which is substantially right angles in FIG. 9 and thus is readily deformed elastically. Further, the blade portion 212 is provided at only the L1 portion and does not extend to the bent portion 211*e*. This is because if the blade portion 212 covers the bent portion 211*e*, the blade portion 212 adversely affects the elastic deformation of the L2 portion.

By the above-described constitution, even when the friction coefficient between the photosensitive drum 201 and the blade portion 212 is increased, an increase in the contact pressure of the cleaning member 210 exerted on the photosensitive drum 201 can be suppressed. That is, in the cleaning member 210 having such a constitution, turning-up of the blade portion 212 can be suppressed.

Further, on the other hand, as described also in Embodiment 1, as the constitution for stabilizing the contact pressure of the cleaning member 210 to the photosensitive drum 201 as shown in FIG. 9, the first bent portions 211*c* and 211*d* are formed at the longitudinal end portions of the blade supporting portion 211*a*. As a result, even in the case where the flexible supporting member 211 such as the thin metal plate is used, the deformation at the longitudinal end portions of the blade supporting portion 211*a* can be suppressed. Therefore, also in the constitution in which the bent portion 211*e* is provided, the rigidity of the L1 portion can be enhanced while maintaining the flexibility of the L2 portion, so that the contact state of the blade portion 212 to the photosensitive drum 201 can be stabilized with respect to the longitudinal direction.

In this embodiment, the constitution in which the L1 portion and the L2 portion are connected via the bent portion 211*e* was described. However, as in the case of a cleaning member 410 shown in FIG. 10, a supporting member 411 may have a curved shape as a whole. The supporting member 411 includes a bent top 411*e* between a blade supporting portion 411*a* and a portion to be fixed 411*b*. The bent top 411*e* is located in a side remote from a surface of a photosensitive drum 401 toward an outside with respect to a line segment L4 connecting the portion to be fixed 411*b* and a contact portion 412*a* where the blade portion 412 is contacted to the photosensitive drum 401. Further, at longitudinal end portions of the blade supporting portion 411*a*, similarly as in Embodiment 1, first bent portions 411*c* and 411*d* are provided. By employing the above-described constitution, an effect similar to that of the cleaning member 310 can be achieved.

Also in this embodiment, the various modified examples as described in Embodiment 1 can be similarly carried out.

(Embodiment 3)

Further, the cleaning members described in Embodiments 1 and 2 are also applicable as a cleaning member for an image forming apparatus 500 capable of forming a color image. FIG. 12 shows an example of the image forming apparatus 500 of a tandem type. The image forming apparatus is a 4-drum type (in-line) printer in which a plurality of process cartridges 517 are provided and color toner images are once successively transferred superposedly onto an intermediary transfer belt 518 as an intermediary transfer member which is a second image bearing member (image carrying member) to obtain a full-color print image.

In FIG. 12, the endless intermediary transfer belt 518 is stretched by a driving roller 518*a*, a tension roller 518*b* and a secondary transfer opposite roller 518*c* and is rotationally driven in an arrow direction indicated in the figure. Four process cartridges 517 are disposed in line with the intermediary transfer belt 518 in the order of those for yellow 517Y, magenta 517M, cyan 517C and black 517K.

In the image forming apparatus of the tandem type, four cleaning devices (511Y, 511M, 511C, 511K) each including a cleaning member 510 having the second bent portion described in Embodiment 2 are provided. Therefore a driving torque generated during drive of photosensitive drums (501Y, 501M, 501C, 501K) is large. However, when the cleaning member 510 in this embodiment is used, a reducing effect of the driving torque becomes large.

Further, as shown in FIG. 12, a cleaning member 519*a* having the second bent portion described in Embodiment 2 is applicable to an intermediary transfer belt cleaner 519 for removing the toner remaining on the intermediary transfer belt 518. In this embodiment, a constitution in which the toner collected by the intermediary transfer belt cleaner 519 is conveyed to a residual toner collecting container (not shown) by a screw is employed.

(Embodiment 4)

Further, the above-described embodiments are also applicable as a cleaning device for a transfer and conveyance belt 621 which is a conveying member for conveying the recording material 607 and for transferring the toner image from the photosensitive drum 601. FIG. 13 shows an example of a color image forming apparatus 600 of a tandem type including the transfer and conveyance belt 621. In FIG. 13, the endless transfer and conveyance belt 621 is stretched by a driving roller 621*a*, a tension roller 621*b* and a follower roller 621*c* and is rotationally driven in an arrow direction indicated in the figure. Four process cartridges 617 are disposed in line with the transfer and conveyance belt 621 in the order of those for yellow 617Y, magenta 617M, cyan 617C and black 617K. The recording material 607 is conveyed by the transfer and conveyance belt 621 and onto which toner images formed on photosensitive drums (601Y, 601M, 601C, 601K) are successively transferred by transfer rollers (609Y, 609M, 609C, 609K). On the photosensitive drums (601Y, 601M, 601C, 601K), a fog toner is present, and the surface of the transfer and conveyance belt 621 is contaminated with the fog toner during an interval of adjacent recording materials 607. This fog toner is collected by a transfer and conveyance belt cleaner 622. The cleaner 622 includes a cleaning member 622*a* having the second bent portion described in Embodiment 2.

As described above, according to the present invention, in the cleaning member including the flexible supporting member, non-uniformity of the contact pressure of the cleaning member applied to the member to be cleaned can be suppressed with respect to the longitudinal direction and thus it becomes possible to maintain the stable cleaning property.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 201836/2011 filed Sep. 15, 2011, which is hereby incorporated by reference.

What is claimed is:

1. A cleaning member, to be fixed to a fixing portion, for removing a developer from a surface of a member to be cleaned, said cleaning member comprising:

a blade portion contactable to the member to be cleaned; and a flexible supporting member for supporting said blade portion and having an area contacting said blade portion, said flexible supporting member comprising a blade supporting portion on which said blade portion is provided, a portion to be fixed at the fixing portion, and a bent portion provided at a longitudinal end portion of the blade supporting portion, wherein the bent portion and the blade portion extend from opposite sides of the area.

2. A cleaning member according to claim 1, wherein said blade portion is provided on said flexible supporting member so as to partly cover the bent portion.

3. A cleaning member according to claim 1, wherein the bent portion is provided at each of the longitudinal end portions of the blade supporting portion.

4. A cleaning member according to claim 1, wherein said blade portion is contactable to the member to be cleaned with respect to a counter direction to a movement direction of the member to be cleaned.

5. A cleaning member according to claim 1, wherein said flexible supporting member further comprises a second bent portion between the blade supporting portion and the portion to be fixed, the second bent portion being disposed on a side remote from a surface of the member to be cleaned that is outside of a line connecting the portion to be fixed and a contact portion where said blade portion is contacted to the member to be cleaned.

6. A cleaning member according to claim 5, wherein the portion to be fixed is provided downstream of the contact portion with respect to a movement direction of the member to be cleaned, and wherein said blade portion includes a supporting member to be supported by only the blade supporting portion.

7. A cleaning member according to claim 1, wherein said flexible supporting member has a curved shape and further comprises a bent top between the blade supporting portion and the portion to be fixed, the bent top being disposed on a side remote from a surface of the member to be cleaned that is outside of a line connecting the portion to be fixed and a contact portion where said blade portion is contacted to the member to be cleaned.

8. A cleaning member according to claim 1, wherein said flexible supporting member is a leaf spring of metal.

9. A cleaning member according to claim 1, wherein the bent portion extends in a remote direction from the area.

10. A cleaning member according to claim 9, wherein the blade portion extends in a direction opposite to the remote direction.

11. A cleaning member according to claim 1, wherein the blade portion extends in an approach direction to the member to be cleaned.

12. A cleaning device for use with an image forming apparatus, the cleaning device comprising:

(a) a fixing portion provided on a frame;

(b) a cleaning member for removing a developer from a surface of a member to be cleaned, said cleaning member comprising:

a blade portion contactable to the member to be cleaned; and a flexible supporting member for supporting said blade portion and having an area contacting said blade portion, said flexible supporting member comprising a blade supporting portion on which said blade portion is provided, a portion to be fixed to the fixing portion, and a bent portion provided at a longitudinal end portion of the blade supporting portion; and (c) an accommodating portion for accommodating the developer removed from the member to be cleaned, wherein the bent portion and the blade portion extend from opposite sides of the area.

13. A cleaning device according to claim 12, wherein said blade portion is provided on said flexible supporting member so as to partly cover the bent portion.

14. A cleaning device according to claim 12, wherein the bent portion is provided at each of the longitudinal end portions of the blade supporting portion.

15. A cleaning device according to claim 12, wherein said blade portion is contactable to the member to be cleaned with respect to a counter direction to a movement direction of the member to be cleaned.

16. A cleaning device according to claim 12, wherein said flexible supporting member further comprises a second bent portion between the blade supporting portion and the portion to be fixed, the second bent portion being disposed on a side remote from a surface of the member to be cleaned that is outside of a line connecting the portion to be fixed and a contact portion where said blade portion is contacted to the member to be cleaned.

17. A cleaning device according to claim 16, wherein the portion to be fixed is provided downstream of the contact portion with respect to a movement direction of the member to be cleaned, and wherein said blade portion includes a supporting member to be supported by only the blade supporting portion.

18. A cleaning device according to claim 12, wherein said flexible supporting member has a curved shape and further comprises a bent top between the blade supporting portion and the portion to be fixed, the bent top being disposed on a side remote from a surface of the member to be cleaned that is outside of a line connecting the portion to be fixed and a contact portion where said blade portion is contacted to the member to be cleaned.

19. A cleaning device according to claim 12, wherein said flexible supporting member is a leaf spring of metal.

20. A process cartridge detachably mountable to an image forming apparatus, the process cartridge comprising:

(a) a photosensitive drum which is a member to be cleaned;

(b) a fixing portion provided on a frame; and (c) a cleaning member for removing a developer from a surface of a member to be cleaned, said cleaning member comprising:

a blade portion contactable to the member to be cleaned; and a flexible supporting member for supporting said blade portion and having an area contacting said blade portion, said flexible supporting member comprising a blade supporting portion on which said blade portion is provided, a portion to be fixed to the fixing portion, and a bent portion provided at a longitudinal end portion of the blade supporting portion, wherein the bent portion and the blade portion extend from the opposite sides of the area.

21. A process cartridge according to claim 20, wherein said blade portion is provided on said flexible supporting member so as to partly cover the bent portion.

22. A process cartridge according to claim 20, wherein the bent portion is provided at each of the longitudinal end portions of the blade supporting portion.

23. A process cartridge according to claim 20, wherein said blade portion is contactable to the member to be cleaned with respect to a counter direction to a movement direction of the member to be cleaned.

24. A process cartridge according to claim 20, wherein said flexible supporting member further comprises a second bent portion between the blade supporting portion and the portion to be fixed, the second bent portion being disposed on a side remote from a surface of the member to be cleaned that is outside of a line connecting the portion to be fixed and a contact portion where said blade portion is contacted to the member to be cleaned.

25. A process cartridge according to claim 24, wherein the portion to be fixed is provided downstream of the contact portion with respect to a movement direction of the member to be cleaned, and wherein said blade portion includes a supporting member to be supported by only the blade supporting portion.

26. A process cartridge according to claim 20, wherein said flexible supporting member has a curved shape and further comprises a bent top between the blade supporting portion and the portion to be fixed, the bent top being disposed on a side remote from a surface of the member to be cleaned that is outside of a line connecting the portion to be fixed and a contact portion where said blade portion is contacted to the member to be cleaned.

27. A process cartridge according to claim 20, wherein said flexible supporting member is a leaf spring of metal.

28. A cleaning member, to be fixed to a fixing portion, for removing a developer from a surface of a member to be cleaned, said cleaning member comprising:

a blade portion contactable to the member to be cleaned; and a flexible supporting member for supporting said blade portion, said flexible supporting member comprising a blade supporting portion on which said blade portion is provided, a portion to be fixed at the fixing portion, and a bent portion provided at a longitudinal end portion of the blade supporting portion, wherein said blade portion is provided on said flexible supporting member so as to partly cover the bent portion.

29. A cleaning device for use with an image forming apparatus, the cleaning device comprising:

(a) fixing portion provided on a frame;

(b) a cleaning member for removing a developer from a surface of a member to be cleaned, said cleaning member comprising:

a blade portion contactable to the member to be cleaned; and a flexible supporting member for supporting said blade portion, said flexible supporting member comprising a blade supporting portion on which said blade portion is provided, a portion to be fixed to the fixing portion, and a bent portion provided at a longitudinal end portion of the blade supporting portion; and (c) an accommodating portion for accommodating the developer removed from the member to be cleaned, wherein said blade portion is provided on said flexible supporting member so as to partly cover the bent portion.

30. A process cartridge detachably mountable to an image forming apparatus, the process cartridge comprising:

(a) a photosensitive drum which is a member to be cleaned;

(b) a fixing portion provided on a frame; and (c) a cleaning member for removing a developer from a surface of a member to be cleaned, said cleaning member comprising:

a blade portion contactable to the member to be cleaned; and a flexible supporting member for supporting said blade portion, said flexible supporting member comprising a blade supporting portion on which said blade portion is provided, a portion to be fixed to the fixing portion, and a bent portion provided at a longitudinal end portion of the blade supporting portion, wherein said blade portion is provided on said flexible supporting member so as to partly cover the bent portion.

* * * * *